United States Patent [19]

Chervin

[11] 4,043,145

[45] Aug. 23, 1977

[54] FINGER RING WITH MEANS FOR LOCKING BEHIND THE KNUCKLE

[76] Inventor: André Chervin, 7 Old Lyme Road, Chappaqua, N.Y. 10514

[21] Appl. No.: 614,765

[22] Filed: Sept. 18, 1975

[51] Int. Cl.[2] ..... A44C 9/00

[52] U.S. Cl. ..... 63/15; 63/15.6

[58] Field of Search ..... 63/15.6, 15; D45/10 A, D45/10 B, 10 C; D11/26, 29

[56] References Cited

U.S. PATENT DOCUMENTS

| | | | |
|---|---|---|---|
| 1,115,764 | 11/1914 | Applas | 63/15.6 |
| 1,542,087 | 6/1925 | Phoel | 63/15.6 |
| 1,548,646 | 8/1925 | Akeson | 63/15 |
| 3,261,181 | 7/1966 | Scott | 63/15 |
| 3,360,959 | 1/1968 | Schechter et al. | 63/15.6 |
| 3,385,079 | 5/1968 | Hollen | 63/15 |
| 3,483,718 | 12/1969 | Lodrini | 63/15.6 |
| 3,557,551 | 1/1971 | DeSanto | 63/15.6 |
| D. 64,849 | 6/1924 | Granat | 63/15 UX |
| D. 67,567 | 6/1925 | Alterton | 63/15 UX |
| D. 70,002 | 4/1926 | Kronstadt | D45/10 A |
| D. 124,824 | 11/1940 | Vogel | D45/10 A |
| D. 212,302 | 9/1968 | Lodrini | 63/15.6 X |

FOREIGN PATENT DOCUMENTS

| | | | |
|---|---|---|---|
| 474,313 | 6/1951 | Canada | 63/15.6 |
| 51,545 | 4/1890 | Germany | 63/15.6 |
| 2,357,054 | 6/1974 | Germany | 63/15 |

*Primary Examiner*—F. Barry Shay

*Attorney, Agent, or Firm*—Davis, Hoxie, Faithfull & Hapgood

[57] ABSTRACT

A contoured finger ring has a finger receiving aperture with five approximately equal sides and which is configured to pass the knuckle therethrough while the ring is at a ninety degree angle to its proper position thereon and to lock on the finger proximally of the knuckle when righted. It resists turning about the knuckle and is exteriorally configured to accommodate adjacent fingers, thereby suppressing discomfort due to pressure and rubbing against the adjacent fingers.

6 Claims, 1 Drawing Figure

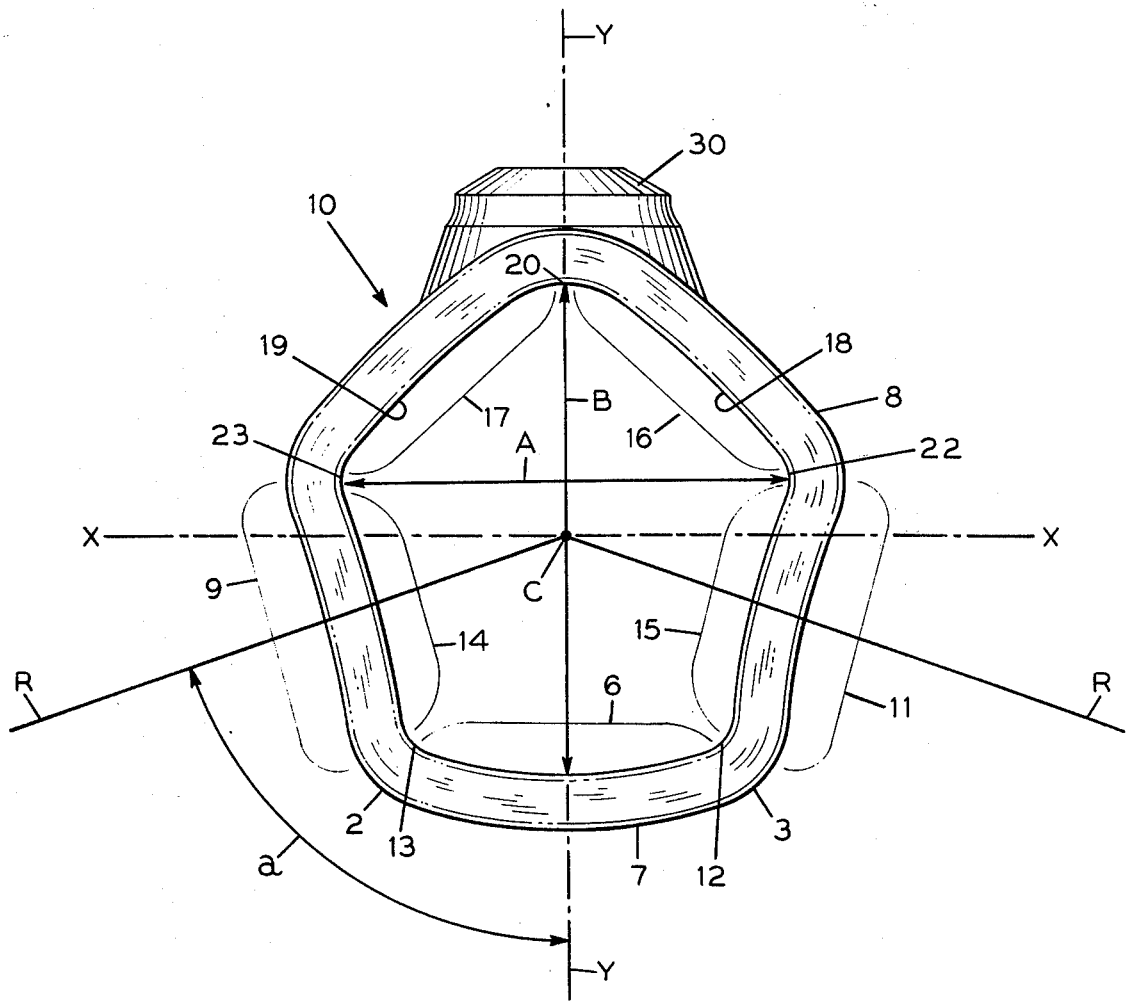
Y
30
10
20
19
18
8
B
17
16
23
A
22
X
X
9
C
15
14
R
6
R
11
2
13
3
a
7
12
Y

FINGER RING WITH MEANS FOR LOCKING BEHIND THE KNUCKLE

BACKGROUND OF THE INVENTION

Nearly all finger rings employ a circular or substantially circular finger aperture having an interior diameter dictated by the size of the wearer's finger first joint knuckle. The ring must be large enough in diameter to slip past the knuckle. Since this interior diameter is larger than the width or depth of the shaft of the first row phalanx bone and flesh of the finger where rings are normally worn, the ring fits the finger loosely, thereby allowing the ring to freely turn about the finger and allowing the ring to inadvertently slip off over the knuckle. Further, the exterior diameter of a circular ring must be so great that the ring presses against the adjacent fingers, thereby causing a discomfort which is a common complaint of ring wearers.

Turning of rings about the finger is annoying since the gem or artwork carried by the ring fails to remain centered on the dorsal surface of the finger as is normally desired. The gem or artwork may rub against or injure adjacent fingers and may turn to appear on the palmar side of the hand where it may interfere with the wearer's grip, be damaged or cause damage to other objects.

The inherent looseness of circular finger rings may result in accidental loss by slipping over the wearer's knuckle during rapid hand movement or when the skin of the wearer's hand is cold, wet or lubricated with materials such as oil or soap. Valuable rings have been stolen from the hand of the wearer.

The contact of traditional circular finger rings with the adjacent fingers may be uncomfortable, especially when a particular ring is only infrequently worn, and when more frequently worn, the constant rubbing against adjacent fingers wears away the soft metal of the ring resulting in loss of decoration or weakening of gem settings.

A further disadvantage of the traditionally circular finger ring is caused by the gaps which result from nonconformance of the ring to the shape of that portion of the finger encircled by the ring. These gaps can cause the ring to catch on objects or in machinery.

Rings of non-circular biaxially symmetrical shapes are known, but have not achieved significant marketplace acceptance. Toelcke U.S. Pat. No. 1,913,463 shows a generally rectangular ring having a major axis dimension greater than the lateral dimension of the knuckle, whereby alignment of the major axis with the lateral dimension of the knuckle allows the ring to be slipped over the knuckle. The minor axis dimension of the ring is smaller than the knuckle. The ring can be turned after placement on the finger to prevent removal of the ring. When so turned, rectangular or oval biaxially symmetrical rings feel loose because of excessive clearance on the dorsal and palmar sides of the finger. Scott U.S. Pat. No. 3,261,181 discusses oval rings and discloses a ring of special shape which is said to lock on the finger with less looseness than provided by an oval ring. Gronat U.S. Pat. No. Des. 64,849 shows a ring which is a cross between a rectangle and an oval. A generally square ring is shown in Herzog U.S. Pat. No. 1,687,020 wherein it is asserted that such a shape fits more snuggly between the fingers and is less inclined to turn than circular rings.

The contoured ring of the present invention simultaneously avoids each of the above described disadvantages. The ring of the present invention locks on the finger proximally of the knuckle, is resistant to turning about the finger, avoids pressing against adjacent fingers and has little or no interior space not occupied by the wearer's finger. The result is a ring which is far more comfortable and safer to wear than traditional circular or other symmetrical shapes.

The aspect of the anatomy of a finger which is involved in the wearing of finger rings comprises the first and second phalanx bones, ligaments, tendons, flesh and the articular surfaces of these bones. Rings are normally worn encircling the shaft of the first phalanx. The proximal end of the second phalanx and the distal end of the first phalanx comprise the bone structure of the knuckle. The ends of the phalanges are enlarged to form the articular surfaces and constitute the prominence of the knuckle. The dorsal side of the first phalanx is convex and is tightly covered by skin with little compressive yield. The palmar side of the first phalanx has a yielding fleshy pad and flexion tendons more loosely covered by the skin. Thus, the portion of the finger where a ring is usually worn is an unyielding convex surface on the dorsal side and a fleshy pad on the palmar side. The greatest transverse dimension of the finger is the unyielding lateral or width dimension of the knuckle of the first and second phalanges. This dimension is greater than the dimensions of the shaft of the first phalanx and the flesh encircled by a ring.

BRIEF DESCRIPTION OF DRAWINGS

The drawing is an elevational view of a finger ring in accordance with the present invention.

DESCRIPTION OF A PREFERRED EMBODIMENT

The ring 10 shown in the drawing is of a shape which is assymmetrical with respect to the lateral axis *x—x* and symmetrical with respect to the dorsal-palmar axis *y—y*. The lateral axis *x—x* bisects the dorsal-palmar axis *y—y* to establish a center C. It is shown surmounted by a gem or artwork prominence 30, although the presence of a prominence 30 is not essential to the invention. The dorsal portion of the aperture of the ring is formed by angularly intersecting outward or convex top curved surfaces 16 and 17 which meet at a peak 20 on the dorsal center and extend to regions 22, 23 at the lateral maximum dimensions of the aperture. Regions 22, 23 are located dorsally above the lateral center line *x—x* of the aperture. Inward or concave side curved surfaces 14, 15 extend from regions 22, 23 to intersect in interior corners 12, 13 with a slightly convex bottom curve 6 which extends perpendicular to the dorsal-palmar axis. Convex curved surfaces 16, 17 and 6 are generally arcuate with a radius greater than the radius of a circular ring sized to fit the same finger.

The external shape of the ring generally duplicates that of the interior aperture although considerable departure is permissible for decorative purposes in the top or dorsal exterior portion 8. Concave or inward curved surfaces 9 and 11 converge inwardly to meet in a generally flat or slightly convex bottom surface 7 perpendicular to the dorsal-palmar axis and having rounded transition 2, 3 at the intersections. Concave side surfaces 9 and 11 approximate arcs centered on radii R at an angle of less than 90° from the dorsal-palmar axis *y—y*, preferably between 40° and 80°, and most preferably between 50° and 70°. This location of the side surfaces accommodates the relative positions of the fingers of a relaxed hand.

The finger size determining dimension of the interior aperture is the dorsal-palmar axis dimension B which corresponds to the lateral width of the knuckle. Since the maximum knuckle dimension is lateral, the ring must be turned 90° to pass the knuckle and be returned to the normal aspect when past the knuckle to bring the top of the ring or the artwork 30 to the dorsal center of the finger. Because the dimensions such as A of the ring aperture measured laterally or parallel to axis *x—x* are less than dimension B, the ring will not pass the knuckle until it is turned 90°. Thus, once in place, the ring is locked on the finger proximally of the knuckle.

When locked on the finger, regions 18 and 19 in the middle of convex surfaces 17 and 18 at the top of the ring bear on the dorsal side of the finger. The fleshy portion of the palmar side of the finger is encompassed by side surfaces 14, 15 and bottom surface 6. The fleshy portion of the palmar side of the finger is gently deformed into general conformance with these surfaces. Part of the fleshy portion is displaced into corners 12 and 13. Turning the ring is resisted by the gentle deformation of the fleshy portion of the finger with the result that the top of the ring or the gem or artwork prominence 30 tends to remain centered on the dorsal center of the finger.

The ring is in bearing contact with the finger along surfaces of concave side curves 14, 15 and bottom curve 6. Midportions 18, 19 of the top curves 16, 17 also bear against the dorsal surface of the finger. Thus, there is no looseness in the fit of the ring with the result that the ring is not able to shift laterally or vertically. In contrast, a circular, rectangular or oval ring is not restrained against vertical movement because the major axis dimension is greater than the vertical dimension of the finger.

Incurved exterior side portions 9, 11 accommodate the adjacent fingers and prevent the ring from bearing on and rubbing against the adjacent fingers. Preferably, the exterior incurved surfaces 9, 11 are generally arcuate in accommodation of the shape of the adjacent fingers and are positioned, with respect to the rest of the ring, to accommodate the natural curve along which the fingers of a relaxed hand lie. The curves 9, 11 are constructed with centers on radial lines R at about 60° ± about 20° from the vertical axis *y—y* of the ring. This positioning of curves 9, 11 accommodates the curve of the hand since the longitudinal axes of the adjacent fingers of a relaxed hand lie below the longitudinal axis of the ring finger. The exterior bottom 7 of the ring is substantially flat so as to conform with the flatness of the palm. The bottom 7 of the ring constitutes less of a protrusion on the palmar side of the hand than does a circular or oval ring.

In consequence of the above described features, the ring of the present invention locks behind the knuckle, resists turning, is snug on the finger, avoids contact with adjacent fingers, offers less protrusion, is more comfortable and is less subject to wear or damage than conventional rings.

What is claimed is:

1. A finger ring which locks on the finger and resists turning having a finger receiving aperture symmetrical with respect to the dorsal-palmar axis of the aperture and assymetrical with respect to the lateral axis, the dorsal-palmar axial dimension of the aperture accommodating the lateral dimension of the finger knuckle and being greater than the maximum lateral dimension of the aperture, said maximum lateral dimension accommodating the dorsal-palmar dimension of said finger knuckle, said aperture being bounded by five approximately equal length sides, said sides having surfaces which define the shape of said aperture and which comprise two straight to slightly outwardly curved dorsal surfaces which intersect in a central dorsal peak, each of said dorsal surfaces having a mid-portion, a laterally extending generally straight to slightly outwardly curved palmar surface, and a pair of inwardly curved side surfaces, said mid-portions, palmar surface, and side surfaces bearing against the corresponding surfaces of the finger when the ring is properly fitted thereon, said side and palmar surfaces intersecting in a pair of interior corners into which the palmar portion of the finger is adapted to be displaced as said side and palmar surfaces bear against the palmar portion of the finger.

2. The ring of claim 1 wherein the lateral separation between the intersections of the pair of dorsal surfaces with the side surfaces constitutes the greatest lateral dimension of the finger receiving aperture.

3. The ring of claim 1 wherein the exterior configuration of the ring includes generally concave surface means for accommodating the fingers adjacent the finger on which the ring is worn.

4. The ring of claim 1 having an exterior configuration including a pair of generally concave surfaces on opposite sides of the ring dorsal-palmar axis for accommodating the fingers adjacent the finger on which the ring is worn, said concave surfaces being in the general form of arcs having centers located on lines each extending radially of the ring at an angle of between 40° and 80° with the dorsal-palmar axis.

5. The ring of claim 4 wherein the angle is between 50° and 70°.

6. The ring of claim 4 wherein the exterior configuration includes a slightly convex palmar portion which extends generally perpendicular to the dorsal-palmar axis.

* * * * *